United States Patent [19]

Applegate

[11] Patent Number: 4,771,709

[45] Date of Patent: Sep. 20, 1988

[54] INCINERATION AIR SUPPLY APPARATUS

[76] Inventor: William G. Applegate, 241 E. 1050 South, Lafayette, Ind. 47905

[21] Appl. No.: 948,185

[22] Filed: Dec. 31, 1986

[51] Int. Cl.[4] ..... F23G 5/00

[52] U.S. Cl. ..... 110/235; 110/244; 110/251

[58] Field of Search ..... 126/271.1, 271.2, 271.3; 110/235, 244, 251, 239, 241

[56] References Cited

U.S. PATENT DOCUMENTS

| | | | |
|---|---|---|---|
| 2,483,728 | 10/1949 | Glaeser | 110/244 |
| 2,754,779 | 7/1956 | Toepel | 110/251 |
| 3,076,421 | 2/1963 | Spitz | 110/18 |
| 3,498,240 | 3/1970 | Trott | 110/241 |
| 3,536,018 | 10/1970 | Phelps et al. | 110/244 |
| 3,704,676 | 12/1972 | Davies et al. | 110/8 R |
| 3,727,563 | 4/1973 | Hasselbring et al. | 110/244 |
| 3,773,000 | 11/1973 | Applegate | 110/8 R |
| 3,777,678 | 12/1973 | Lutes et al. | 110/244 |
| 3,785,302 | 1/1974 | Davis | 110/8 C |
| 3,785,303 | 1/1974 | Hopkins | 110/8 R |
| 3,899,984 | 8/1975 | Keyes | 110/18 R |
| 3,961,587 | 6/1976 | Ozawa | 110/251 |
| 4,391,205 | 7/1983 | Morey | 110/251 |
| 4,453,474 | 6/1984 | Lewis | 110/244 |
| 4,635,573 | 1/1987 | Santen | 110/244 |

*Primary Examiner*—Henry C. Yuen

*Attorney, Agent, or Firm*—Luedeka, Hodges & Neely

[57] ABSTRACT

Disclosed is an air supply apparatus for open pit incineration for supplying a curtain or layer of combustion air into an open pit. A plenum is provided for being positioned alongside of the pit and a fan and conduit provide air to the plenum. An elongate nozzle directs air from the plenum into the pit in a curtain or layer. Means are provided for selectively exhausting air from the conduit to adjust the volume of air being directed by the nozzle into the pit. Also disclosed is a secondary air supply for air curtain incineration in permanent or semi-permanent pits having walls provided by refractory panels. The plenum and nozzle are positioned adjacent one wall to direct the air curtain so that it primarily impinges upon an opposite wall. The secondary air supply introduces air into the pit at the wall adjacent to the plenum.

9 Claims, 2 Drawing Sheets

INCINERATION AIR SUPPLY APPARATUS

The present invention relates to the incineration of refuse and more particularly relates to apparatus for supplying air for the incineration of refuse in an open pit.

Open pit incineration utilizing a curtain or layer of air directed into an open pit has been widely used for a variety of refuse burning operations such as the burning of stumps and debris from logging and land clearing operations. For use in remote areas, portable air curtain incineration apparatus such as that disclosed in U.S. Pat. No. 3,773,000 is particularly suitable. Such apparatus includes an elongate plenum for placement along one side of the pit for supplying combustion air to an elongate nozzle which directs air into the pit in a layer or curtain. A fan, typically powered by a gasoline or diesel engine, supplies air to the plenum.

Air curtain incineration is also desirable for use for the disposal of combustible industrial waste and to decrease the volume of certain solid waste to be buried in landfills. For such purposes, a permanent or semi-permanent pit is often employed which includes a metal framework with walls provided by refractory panels. At such permanent or semi-permanent incinerators or at temporary locations where electric power is available, a one-speed electric motor is often preferred for driving the fan used in the incineration air supply apparatus. However, since the air volume is always at its maximum with a one speed motor, too much air is sometimes supplied to the pit. This can be detrimental particularly when the burning is being started and the fire can actually be blown out.

Typically, in air curtain incineration, the air curtain is directed against the wall of the pit opposite the wall from which it is supplied at a desired downward angle which causes the air in the pit to move in a downwardly curling and turbulent manner. However, sufficient air often does not reach the area of the pit adjacent to the wall from which the air curtain is supplied.

Accordingly, a need has arisen for an incineration air supply apparatus for air curtain incineration which facilitates control over the air supplied to the pit. In addition, there is a need for an incineration air supply apparatus for improving combustion of refuse in the pit adjacent to the wall from which a curtain of air is supplied.

In accordance with one form of the invention, there is provided apparatus for supplying air for incinerating refuse in an open pit which includes an elongate plenum for being positioned alongside of the pit. An air supply including a powered fan for creating a flow of air and a conduit supplies a flow of air from the fan to the plenum. From air supplied to the plenum, an elongate nozzle forms and directs a curtain of air into the pit. The apparatus further includes air supply control means for selectively exhausting at least a portion of the flow of air from the fan so that the air is not directed by the nozzle into the pit.

In accordance with a preferred form of the invention, the air supply control includes an outlet in the conduit between the fan and the plenum and means for selectively opening and closing the outlet.

In accordance with a more particular aspect of the present invention, a deflector plate is provided for opening and closing the outlet which is movable between at least one open position where the deflector plate is positioned within the flow of air in the conduit to deflect a portion of the flow of air out of the outlet and the closed position where the deflector plate substantially closes the outlet.

In accordance with another more particular aspect of the present invention, the deflector plate is hinged adjacent its downstream end for opening inwardly into the flow of air in the conduit to deflect air out of the outlet.

In accordance with the invention, there is also provided apparatus for burning refuse including a generally rectangular pit having a floor and two generally parallel upright side walls and two end walls with the side walls being longer in width than the end walls. An elongate plenum is disposed adjacent one of the side walls and an air supply including a powered fan and a conduit supplies a flow of air to the plenum. An elongate nozzle forms a curtain of air from air supplied to the plenum and directs the curtain of air towards the side wall remote from the plenum. Secondary air supply is provided to introduce air to at least one position inside the pit at the side wall adjacent to the plenum to facilitate complete combustion of refuse in the pit to be burned.

The present invention may best be understood by reference to the following detailed description when considered in conjunction with the accompanying drawings in which.

Figures 1, 4, 5, 6:
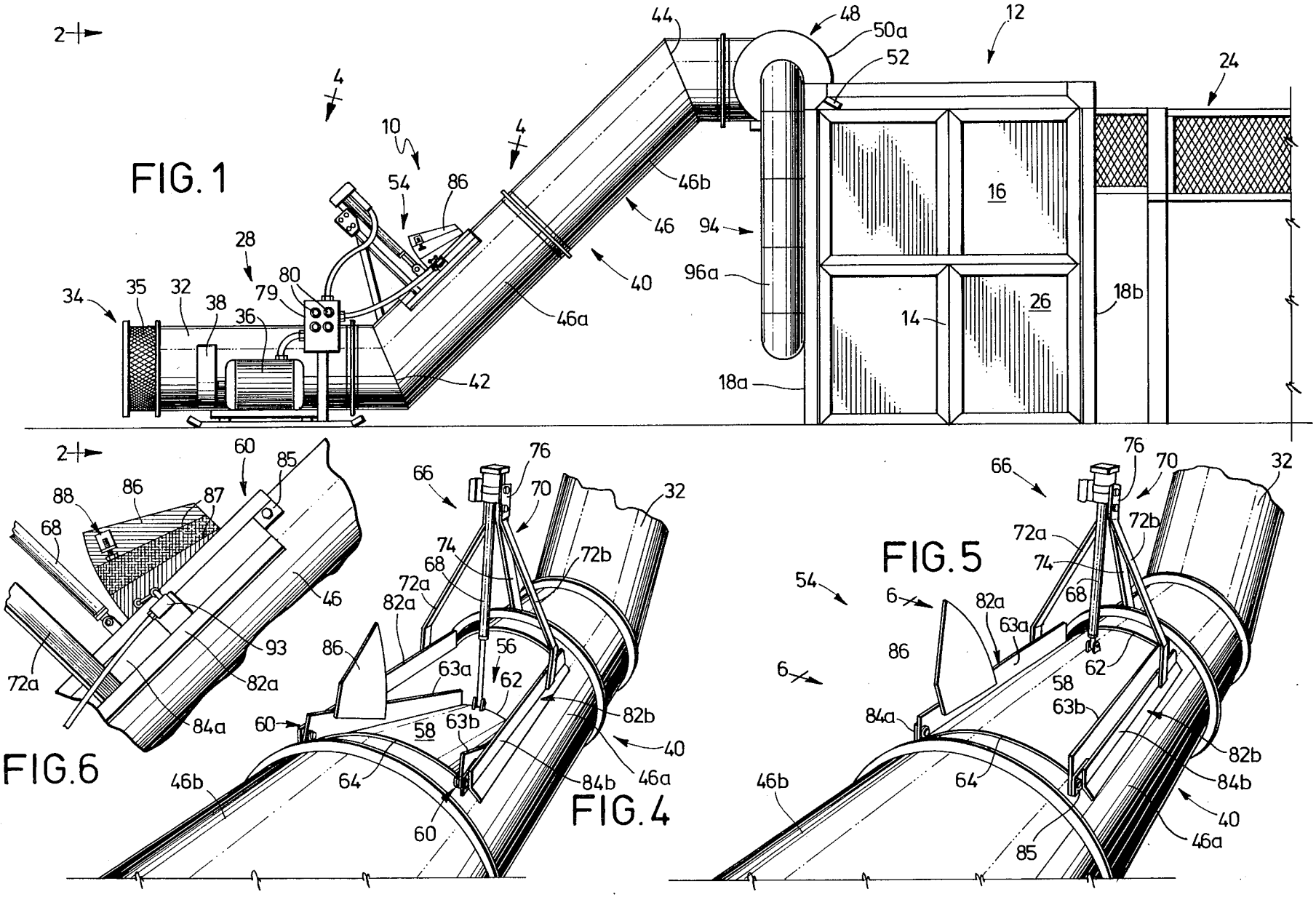
FIG. 1 is a side elevational view an embodiment of the incineration air supply apparatus according to the invention being employed with a permanent pit.
FIG. 4 is a partial, enlarged perspective view of the air supply apparatus of FIG. 1 showing an air control in an open position for exhausting air.
FIG. 5 is a perspective view of the air control or of FIG. 4 shown closed in a closed position.
FIG. 6 is a partial side elevational view of the air control of FIG. 5 (closed position).
Figure 3:
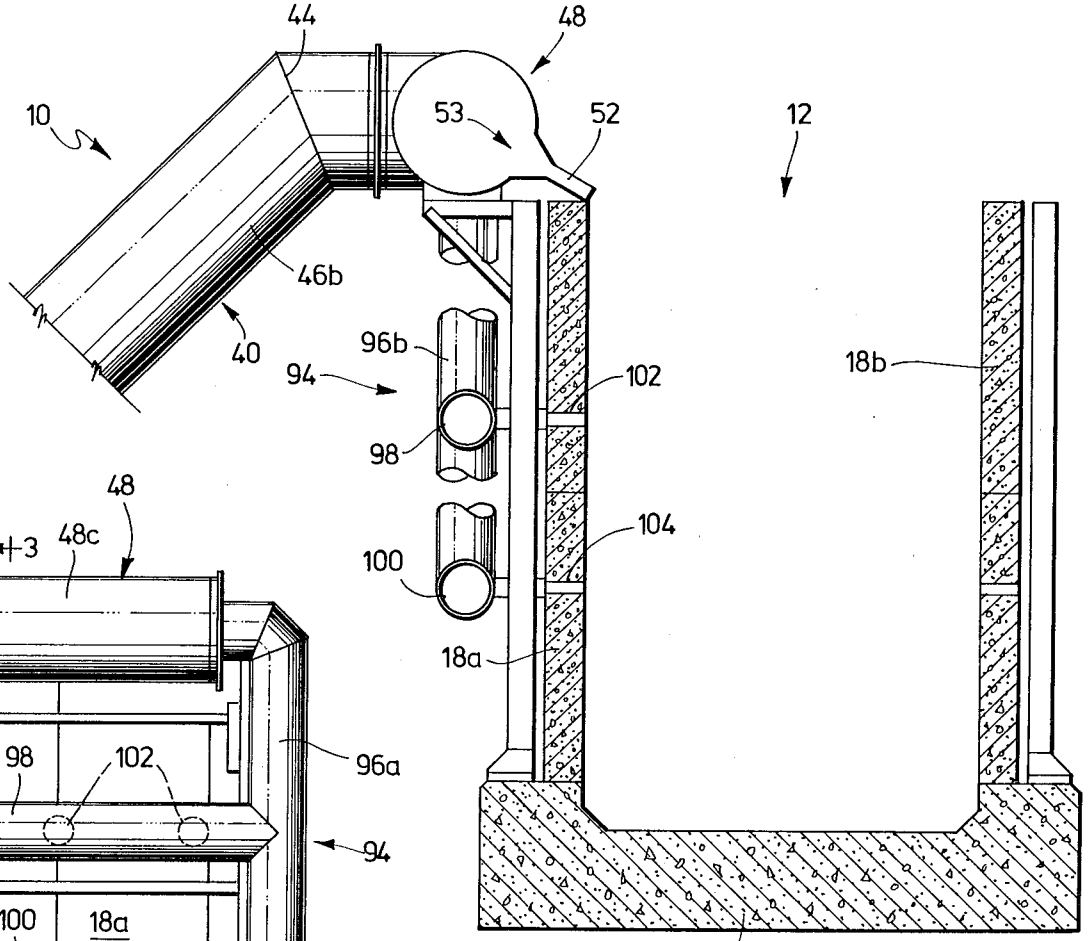
FIG. 3 is a partial cross-sectional side view of a pit illustrated in FIG. 1.
Figure 2:
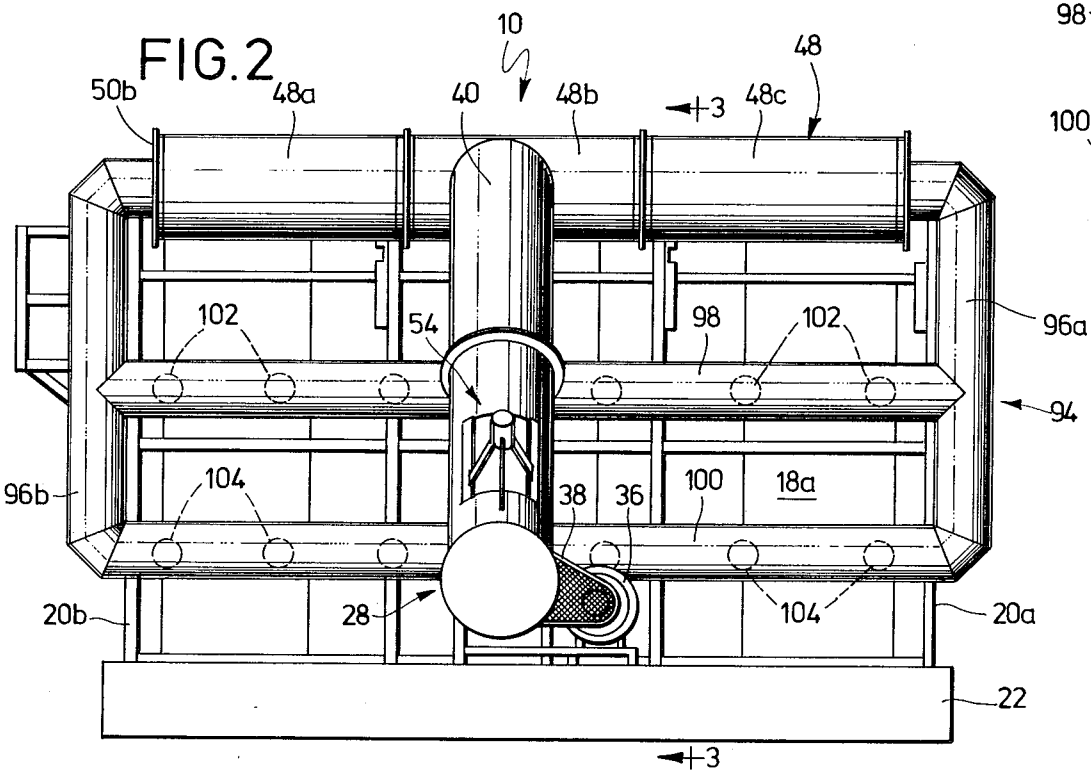
FIG. 2 is an end elevational view of the apparatus and pit of FIG. 1.

Referring now to the drawings in which like reference characters designate like or corresponding parts throughout the several views, there is shown in FIGS. 1 and 2 incineration air supply apparatus 10 being used with a permanent pit 12. Permanent pit 12 includes a framework 14 supporting refractory panels 16. The permanent pit 12 is open-topped and is generally rectangular in shape having first and second side walls **18*a* and 18*b*, respectively, and two end walls 20*a* and 20*b* which are shorter in width than the sidewalls. As shown in FIG. 3, the sidewalls 18*a* and 18*b*, end walls 20*a* and 20*b* and the framework 14 are supported on base 22 which also provides a floor for the pit 12. The permanent pit 12 illustrated is above ground and a loading ramp 24 is provided for deposited refuse from above into the pit 12. Doors 26 are provided on the end wall 20*a* of the pit 12 to provide access for the removal of ash and for inspection and maintenance of the interior of the pit 12**.

Referring still to FIGS. 1 and 2, the air supply apparatus 10 includes an air supply 28 which includes a fan 30 for creating a high velocity flow of air at a volume sufficient for efficient combustion in the pit 12. A preferred fan is disclosed in U.S. Pat. No. 3,773,000, the disclosure of which is hereby incorporated by reference. The fan 30 includes a two-stage axial vane rotor (not shown) journaled within a cylindrically-shaped tubular section 32 of the air supply 28. An air intake 34 with protective screen 35 is provided at the end of the tubular section 32 remote from the pit 12 to enable air to be drawn into the tubular section 32 by the fan 30. Preferably, as disclosed in U.S. Pat. No. 3,773,000, the tubular section 32 is lined with a sound absorbing material to decrease fan noise. In the apparatus 10 depicted, a one-speed electric motor 36 drives the fan through guarded belt and pulleys 38.

The tubular section 32 of the air supply 28 is connected to a conduit 40 which conveys air from the fan 30 to a position above and adjacent to first sidewall 18*a* of the pit. The conduit is preferably cylindrical in shape and has the same diameter as the tubular section 32 of the air supply 28. In the air supply apparatus 10 and pit 12 illustrated, the fan 30 is positioned on the ground and thus the conduit 40 extends upwardly to convey the air above the pit. Conduit 40 thus includes lower bend 42, upper bend 44, and straight section 46 of connected tubing sections 46*a* and 46*b* to deliver the air to the desired elevational position.

Referring now to FIGS. 1, 2, and 3, the air supply apparatus 10 is shown to include a plenum 48 which is positioned above and adjacent to side wall 18*a* and extends substantially along the entire length of side wall 18*a*. The plenum 48 is preferably cylindrical in shape and has approximately the diameter as the conduit 40 and the tubular section 32 of the air supply 28. As illustrated, the conduit 40 joins the plenum at its central area although it will be understood that the conduit 40 can also be connected at or adjacent to an end of the plenum 48. In the embodiment shown, the plenum 48 is formed from interconnected tubing sections 48*a*, 48*b* and 48*c* and has circular cover panels 50*a* and 50*b* for closing off the ends of the tubing sections 48*a* and 48*c*.

As best shown in FIGS. 1 and 3, a nozzle 52 is provided for forming and directing a curtain of air into the pit 12 from air supplied to the plenum 48. The nozzle 52 is elongate and generally rectangular in shape and is provided with air from the plenum 48 through an elongate, rectangular opening 53 in the plenum. The nozzle 52 and the opening 53 preferably extend substantially the entire length of the plenum 48. As shown most clearly in FIG. 3, the nozzle 52 is directed downwardly and into the pit 12 from above the sidewall 18*a* so that the air first impinges upon sidewall 18*b* at an intermediate position. Preferably, the nozzle 52 is reinforced so that any debris being deposited in the pit from above which happens to strike the nozzle 52 will not cause damage to the nozzle which could adversely affect the continuity of the air curtain which is formed and directed into the pit 12 by the nozzle 52. A preferred nozzle 52 is disclosed in U.S. Pat. No. 3,773,000, which is incorporated herein by reference. The nozzle of U.S. Pat. No. 3,773,000 provides a reinforced nozzle construction which maintains a uniform air curtain over its entire length.

The air supply apparatus 10 includes air control 54 for selectively exhausting air supplied by the fan 30 so that it does not enter the plenum 48 and therefore is not directed out of the nozzle 52 and into the pit 12. Combustion air being supplied to the pit 12 is appropriately adjusted using the air control 54.

Referring now with particularity to FIGS. 4 and 5, the air control 54 includes an opening 56 in the wall of the conduit 40 in tubing section 46*a* which provides an outlet for some of the air supplied by the fan 30 to the conduit 40. As shown in the air control 54 depicted, an air deflector 58 is provided to deflect air out of the opening 56 when the air deflector is in an open position as shown in FIG. 4 and to close the opening when in a closed position as shown in FIG. 5.

The opening 56 is preferably generally rectangular in shape and the air deflector 58 is dimensioned and configured to mate with the opening 56 in the wall of the conduit 40. In the preferred embodiment, the air deflector 58 is provided by a plate which has an upstream end 62 oriented toward the fan 30 and a downstream end 64 oriented towards the plenum 48. The plate is preferably attached at its downstream end 64 by hinges 60 so that the air deflector 58 moves inwardly into the flow of air in the conduit 40 with the outer face of the plate being presented to the flow of air to deflect air out of the opening 56. Preferably as illustrated, the air deflector plate 58 has a curvature which is substantially identical to the curvature of the conduit 40 such that when the air deflector plate 58 is in the closed position of FIG. 5, the air control does not interfere with the flow of air through the conduit 40 and the maximum amount of air is supplied by the fan 30 through the conduit 40 to the plenum 48. In addition, the preferred deflector 58 includes blades 63*a* and 63*b* along the side edges of the deflector 58 which reinforce the deflector and promote the deflection of air out of the opening 56.

The air control 54 also includes actuation mechanism 66 attached to the air deflector 58 for moving it between the open position where air is deflected out of the opening 56 the closed position. As shown in FIGS. 4 and 5, the preferred actuation mechanism 66 includes a screw jack 68 connected to the air deflector 58 adjacent the upstream end 62. Rotation of the screw jack 68 causes the upstream end 62 of the air deflector 58 to be advanced into the conduit 40. The screw jack 68 enables the deflector 58 to be positioned in an infinite number of open positions between the open position depicted in FIG. 4 and the closed position depicted in FIG. 5.

The screw jack 68 of the actuation mechanism 66 is suitably supported in an orientation generally perpendicular to the straight section 46 conduit 40 by a screw jack support 70. Preferably, the screw jack support 70 is a tripod having two legs 72*a* and 72*b* which extend downwardly from the upper area of the screw jack 68 to spaced-apart positions so that the legs 72*a* and 72*b* straddle the opening 56. An upstream leg 74 forms the third leg of the tripod and is attached to the conduit adjacent the upstream end of the opening 56. The legs 72*a* and 72*b* and the upstream leg 74 are suitably joined together by screw jack support bracket 76. The screw jack support bracket 76 provides a pivotal connection to the screw jack to enable the screw jack 68 to change its orientation in relation to the screw jack support 70 as the air deflector 58 is opened and closed. In the preferred form of the apparatus, an electric motor and gear reduction 78 are provided to operate the screw jack 10. As shown in FIG. 1, an electric power junction box 79 and control switches 80 are provided in a convenient location adjacent to the air control 54. Control switches 80 actuate the motor and gear reduction 78 in either a forward or reverse direction to drive the screw 68 which moves the the air deflector 58 to open and close the air control 54.

In the preferred form of the invention, side shields 82*a* and 82*b* are preferably provided adjacent the longitudinal sides of the opening 56 which reinforce the conduit walls adjacent the opening 56. In the preferred embodiment, the air control 54 is positioned on the conduit 40 so that the opening 56 is provided in an upwardly-facing orientation so that air is deflected generally upwardly and operators standing close to the apparatus are not hit by the exhausted air. The side shields 82*a* and 82*b* provide generally vertical lips 84*a* and 84*b* with on either side of the opening 56. The lips 84*a* and 84*b* facilitate attachment of the legs 72*a* and 72*b* of the screw jack support 70 to the conduit 40 such as by welding to the lips and provide for a simple hinged attachment of the deflector 58. The hinges 60 depicted employ the downstream ends of the blades 63*a* and 63*b* on air deflector 58 for pivotal attachment to hinge brackets 85 affixed to the lips 84*a* and 84*b*. Bolts or other such fasteners which permit pivotal movement are suitable employed.

In the preferred embodiment, there is an indicator flag 86 attached to the deflector 58 which provides an indication of how far the deflector 58 has been moved inwardly into the conduit 40. As shown in FIG. 6 with the air control in the closed position, the indicator flag 86 can have markings 87 such as color coding if desired designating its position in the conduit 40. The indicator flag is suitably attached to blade 63*a* as shown so that its markings 87 are visible above the lip 84*a* from the position of the control switches 80.

As shown in FIG. 6, it is advantageous to employ a stop 88 which prevents the deflector 58 from being moved too far into the conduit 40 such that it strikes the wall of the conduit 40. As shown, the stop 88 is preferably attached to the indicator flag 86 and is suitably provided by an angle bracket 90 supporting a bolt 92 to enable adjustment of the stop 88 as needed. A limit switch 93 which deactivates the electric motor of the actuation mechanism 66 when contacted by bolt 92 is attached to the side shield 82*a*. The bolt 92 can be adjusted so that the deflector 58 moves to a desired fully opened position before the actuation mechanism stops the travel of the deflector. In the preferred embodiment, the screw jack 68 employed includes an integral limit switch (not shown) which deactivates the actuation mechanism 66 when the deflector 58 in the closed position which is reached when the screw jack is in the fully retracted position as shown in FIG. 5.

Referring again to FIGS. 1, 2, and 3, it is shown that the air supply apparatus 10 includes secondary air supply 94. The secondary air supply 94 includes secondary air conduits 96*a* and 96*b* which extend from the cover panels 50*a* and 50*b* of the plenum 48 to upper and lower secondary plenums 98 and 100 which are positioned adjacent side wall 18*a* of the pit 12. As is best shown in FIGS. 2 and 3, a plurality of upper air nozzles 102 are connected to the upper secondary plenum 98 to supply air to the pit at an upper area along sidewall 18*a*. A plurality of lower air nozzles 104 are connected to the lower secondary plenum 100 and supply air to a lower area along side wall 18*a*. The number of nozzles provided, their dimensions, and the size of the secondary conduits 96*a* and 96*b* and the plenums 98 and 100 are suitable to supply sufficient air to the upper and lower air nozzles 102 and 104 to facilitate combustion in the pit 12 adjacent side wall 18*a*. It is off course desirable for the secondary air withdrawn from the plenum 48 to be limited so that the air curtain directed from the nozzle 52 is not adversely affected.

In operation, electric motor 36 drives the fan 30 and air is drawn through air intake 34 and into the conduit 40 to be supplied to the plenum 48. When burning is being initiated in the pit 12, the air control 54 is actuated by the control switches 80 and appropriately adjusted so that sufficient air is exhausted from the opening 56 so that a lesser amount of air is directed out of the nozzle 52 and into the pit 12. The control switches 80 operates the motor and gear reduction 78 to turn the screw jack 68 to move air deflector 58 into the air flow in the conduit 40 to deflect air out of opening 56. As the burning progresses and the fire is well established in the pit, the air control 54 is adjusted so that less air is exhausted through the opening 56. Indicator flag 86 is used to view the extent to which the air control 54 is open or closed. The volume of air being exhausted can be decreased incrementally if desired until the pit 12 is receiving the full volume of air from the fan.

During combustion, the secondary air supply 94 supplies air to the pit through the sidewall 18*a* at upper and lower positions through the upper and lower air nozzles 102 and 104 and facilitates combustion adjacent the sidewall 18*a*.

The air supply apparatus 10 according to the invention provides an ideal incineration air supply for air curtain incineration particularly when an electric motor is employed to drive the fan. Since the fan employed in such systems is engineered to supply a high and constant volume of air, the air control in accordance with the invention for exhausting air from the conduit provides accurate control of the air to the pit. It is not necessary to close off the air intake which can cause buffeting and unstable operation. Moreover, the secondary air supply in accordance with the invention provides a very simple and effective supply of secondary combustion air into the pit 12 where it is most effective and functions to supplement the air curtain supplied by the nozzle.

Although a particular embodiment in accordance with the present invention has been described in the foregoing detailed description, it will be understood that the invention is capable of numerous modifications without departing from the spirit of the invention as set forth in the appended claims.

What is claimed is:

1. Apparatus for supplying air for incinerating refuse in an open pit comprising:

an elongate plenum means for being positioned alongside the pit;

air supply means comprising a powered fan for creating a flow of air;

conduit means for supplying said flow of air from said fan to said plenum;

elongate nozzle means for forming and direction in a desired orientation a curtain of air from the flow of air supplied by said plenum into said pit; and air supply control means comprising an outlet in said conduit means between said air supply means and said plenum means for exhausting air from said flow in said conduit means, and means for selectively opening and closing said outlet, said air supply control means selectively exhausting at least a portion of said flow of air supplied by said fan means so that said portion is not directed out of said nozzle and into said pits;

said air supply control means further comprising hinged plate means dimensioned to cover said outlet when in a closed position, said plate means having at least one upstream end generally oriented in relation to the flow of air toward the fan and at least one downstream end generally oriented in relation to the flow of air toward the plenum, said plate means being hingedly mounted adjacent said at least one downstream end with said at least one upstream end moving inwardly into the conduit to an open position to cause air to be deflected out of said outlet.

2. The apparatus of claim 1 further comprising air control actuation means for moving said plate means between said open and closed positions.

3. The apparatus of claim 2, wherein said actuation means comprises means for moving said plate means between and maintaining said plate mean in said open and closed positions and for maintaining said plate means in a plurality of intermediate positions between said open and closed positions.

4. An apparatus of claim 3 wherein said actuation means comprises a support frame and a screw drive attached between said support frame and said plate for moving said plate means between and maintaining said plate means in said open, closed, and intermediate positions.

5. The apparatus of claim 4 wherein said actuation means further comprises a motor for powering said screw drive and a remote switch for actuating said motor.

6. Apparatus for burning refuse comprising:

a generally rectangular pit having a floor and two generally parallel upright side walls and two end walls, said side walls being longer than said end walls;

elongate air supply plenum means disposed adjacent one of said side walls;

air supply means comprising a powered fan for creating a flow of air and conduit means for supplying said flow of air from said fan to said plenum;

elongate nozzle means for forming and directing a curtain of air supplied by said plenum, said nozzle means directing said curtain of towards the side wall remote from said plenum;

secondary air supply means for supplying air to said pit adjacent to said side wall adjacent to said plenum to facilitate complete combustion of material in said pit to be burned, said secondary air supply means comprising secondary air supply conduit means and a plurality of discharge nozzles mounted in said side wall and supplied with air by said secondary air conduit means;

an outlet in said conduit means between said air supply means and said plenum means for exhausting air from said flow in said conduit means;

hinged plate means dimensioned to cover said outlet when in a closed position, said plate means having at least one upstream end generally oriented in relation to the flow of air toward the fan and at least one downstream end generally oriented in relation to the flow of air toward the plenum, said plate means being hingedly mounted adjacent said at least one downstream end with said at least one upstream end moving inwardly into the conduit to an open position to cause air to be deflected out of said outlet.

7. The apparatus of claim 6 further comprising actuation means for moving said plate means between said open and closed positions.

8. The apparatus of claim 7 wherein said actuation means comprises means for moving said plate means between and maintaining said plate means in said open and closed positions and in a plurality of intermediate positions between said open and closed positions.

9. An apparatus of claim 8 wherein said drive means comprises a support frame and a screw drive attached between said support frame and said plate means for moving said plate means between and maintaining said plate means in said open, closed, and intermediate positions.

* * * * *